US009091000B2

(12) United States Patent
Mizobuchi et al.

(10) Patent No.: US 9,091,000 B2
(45) Date of Patent: Jul. 28, 2015

(54) FLAMEPROOF SPUN YARN, FABRIC, CLOTHES AND FLAMEPROOF WORK CLOTHES

(71) Applicants: KANEKA CORPORATION, Osaka-shi, Osaka (JP); KURARAY CO., LTD., Kurashiki-shi, Okayama (JP)

(72) Inventors: Atsushi Mizobuchi, Ibaraki (JP); Takeshi Miura, Osaka (JP); Kazumasa Kusudo, Kurashiki (JP); Junya Ide, Suita (JP)

(73) Assignees: Kaneka Corporation, Osaka (JP); Kuraray Co., Ltd., Okayama (JP)

( * ) Notice: Subject to any disclaimer, the term of this patent is extended or adjusted under 35 U.S.C. 154(b) by 0 days.

(21) Appl. No.: 14/346,139

(22) PCT Filed: Sep. 24, 2012

(86) PCT No.: PCT/JP2012/074382
§ 371 (c)(1),
(2) Date: Mar. 20, 2014

(87) PCT Pub. No.: WO2013/047431
PCT Pub. Date: Apr. 4, 2013

(65) Prior Publication Data

US 2014/0283290 A1 Sep. 25, 2014

(30) Foreign Application Priority Data

Sep. 26, 2011 (JP) ..... 2011-209270

(51) Int. Cl.

| | |
|---|---|
| ***D02G 3/04*** | (2006.01) |
| ***D02G 3/44*** | (2006.01) |
| ***A62B 17/00*** | (2006.01) |
| ***D03D 1/00*** | (2006.01) |
| ***D03D 15/12*** | (2006.01) |
| *A41D 31/00* | (2006.01) |
| *D01F 1/07* | (2006.01) |
| *D01F 6/40* | (2006.01) |

(52) U.S. Cl.
CPC ..... *D02G 3/443* (2013.01); *A62B 17/003* (2013.01); *D02G 3/04* (2013.01); *D03D 1/0035* (2013.01); *D03D 15/12* (2013.01); *A41D 31/0022* (2013.01); *D01F 1/07* (2013.01); *D01F 6/40* (2013.01); *D10B 2321/101* (2013.01); *D10B 2331/042* (2013.01)

(58) Field of Classification Search
CPC ..... D02G 3/443
USPC ..... 57/255, 256
See application file for complete search history.

(56) References Cited

U.S. PATENT DOCUMENTS

| | | | | |
|---|---|---|---|---|
| 4,209,606 | A | 6/1980 | Ciaperoni et al. | |
| 4,863,797 | A | 9/1989 | Ichibori et al. | |
| 4,996,099 | A * | 2/1991 | Cooke et al. | 442/4 |
| 5,981,407 | A | 11/1999 | Matsumoto et al. | |
| 6,048,955 | A * | 4/2000 | Wade | 526/342 |
| 7,690,180 | B2 | 4/2010 | Hegan, Jr. | |
| 7,713,891 | B1 * | 5/2010 | Li et al. | 442/136 |
| 2005/0148256 | A1 | 7/2005 | Adachi et al. | |
| 2005/0208855 | A1 | 9/2005 | Zhu | |
| 2006/0234592 | A1 | 10/2006 | Mio et al. | |
| 2007/0066740 | A1 | 3/2007 | Odle et al. | |
| 2008/0057807 | A1 * | 3/2008 | Tutterow et al. | 442/1 |
| 2008/0153373 | A1 | 6/2008 | Hall et al. | |
| 2009/0019614 | A1 | 1/2009 | Hagihara et al. | |
| 2009/0071117 | A1 * | 3/2009 | Hegan, Jr. | 57/230 |
| 2010/0047513 | A1 | 2/2010 | Hagi | |
| 2010/0299817 | A1 * | 12/2010 | Zhu | 2/458 |
| 2011/0159264 | A1 | 6/2011 | Sullivan | |
| 2013/0065470 | A1 * | 3/2013 | Rock et al. | 442/302 |
| 2013/0209784 | A1 | 8/2013 | Nakagawa et al. | |

FOREIGN PATENT DOCUMENTS

| | | |
|---|---|---|
| CN | 101370873 | 2/2009 |
| CN | 101568678 | 10/2009 |
| CN | 103201344 | 7/2013 |
| EP | 0 183 014 | 6/1986 |
| EP | 1 619 278 | 1/2006 |
| EP | 1 914 333 | 4/2008 |
| EP | 2122029 | 9/2010 |
| EP | 2636703 | 9/2013 |
| JP | 3-193956 | 8/1991 |
| JP | 5-078935 | 3/1993 |
| JP | 5-093330 | 4/1993 |
| JP | 8-218259 | 8/1996 |
| JP | 8-226031 | 9/1996 |
| JP | 9-302552 | 11/1997 |
| JP | 2001-271270 | 10/2001 |
| JP | 2007-002357 | 1/2007 |
| JP | 2007-529649 | 10/2007 |
| JP | 2008-184705 | 8/2008 |
| JP | 2008-190086 | 8/2008 |
| JP | 2008-214845 | 9/2008 |
| JP | 2009-280923 | 12/2009 |

(Continued)

*Primary Examiner* — Shaun R Hurley
(74) *Attorney, Agent, or Firm* — Hamre, Schumann, Mueller & Larson, P.C.

(57) ABSTRACT

A flameproof spun yarn of the present invention includes a modacrylic fiber containing an antimony compound and a polyarylate-based fiber, and the flameproof spun yarn contains 1 to 30 wt % of the polyarylate-based fiber relative to the total weight of the flameproof spun yarn. A flameproof fabric of the present invention includes a modacrylic fiber containing an antimony compound and a polyarylate-based fiber, and the flameproof fabric contains 1 to 30 wt % of the polyarylate-based fiber relative to the total weight of the flameproof fabric. And clothes and flameproof work clothes of the present invention include the flameproof fabric. The present invention thereby provides at a low cost a flameproof spun yarn and a flameproof fabric having excellent designability and flameproofness, and clothes and a flameproof work clothes using the same.

23 Claims, No Drawings

(56) References Cited

FOREIGN PATENT DOCUMENTS

| | | |
|---|---|---|
| JP | 2010-502849 | 1/2010 |
| RU | 2278187 | 6/2006 |
| SU | 973030 | 11/1982 |
| WO | 03/080908 | 10/2003 |
| WO | 2004/097088 | 11/2004 |
| WO | 2005/090660 | 9/2005 |
| WO | 2006/134748 | 12/2006 |
| WO | 2007/116938 | 10/2007 |
| WO | 2008/027454 | 3/2008 |

* cited by examiner

FLAMEPROOF SPUN YARN, FABRIC, CLOTHES AND FLAMEPROOF WORK CLOTHES

TECHNICAL FIELD

The present invention relates to a flameproof spun yarn, flameproof fabric, clothes and flameproof work clothes that can be used for example for a work that requires flameproofness.

BACKGROUND ART

Firefighters and any other workers in a circumstance with a risk of fires require work clothes having excellent flameproofness. Para-aramid fiber, polyarylate-based fiber and the like have been known as fibers having high strength and high heat resistance. Among them, the para-aramid fiber, which is a fiber possessing flameproofness as well as the high strength and high heat resistance, has been used widely for flameproof work clothes, and it has been known to provide higher flameproofness to a fabric when the blend rate is increased. However, an increase in the blend rate of the para-aramid fiber results in price hike of the product, and hinders safe products from becoming widespread. Furthermore, in a fabric that uses the inherently yellowish para-aramid fiber, the hue after dyeing is limited. Therefore, it has been impossible to provide sufficient designability to the flameproof work clothes.

Patent document 1 describes addition of a para-aramid fiber to a fiber mixture including a FR modacrylic fiber as one type of acrylic fibers and a synthetic cellulose fiber for the purpose of providing thermal stability, thereby allowing application of a fabric manufactured from the fiber mixture to protective clothes. Patent document 1 describes also that VECTRAN™ (registered trade name; a polyarylate-based fiber) as one type of polyarylate-based fibers may be added to the fiber mixture including the FR modacrylic fiber as one type of acrylic fibers and a synthetic cellulose fiber. However, since the polyarylate-based fiber is added to improve the wear resistance of the fabric manufactured from the fiber mixture, it has not been easy to imagine the improvement in the flameproofness of a fabric manufactured with the fiber mixture by adding the polyarylate-based fiber to the fiber mixture including the FR modacrylic fiber and the synthetic cellulose fiber.

PRIOR ART DOCUMENTS

Patent Documents

Patent document 1: JP 2010-502849 A

DISCLOSURE OF INVENTION

Problem to be Solved by the Invention

For solving the conventional problems as mentioned above, the present invention provides at a low cost a flameproof spun yarn, a flameproof fabric, clothes and flameproof work clothes having excellent designability and flameproofness.

Means for Solving Problem

A flameproof spun yarn of the present invention includes a modacrylic fiber containing an antimony compound and a polyarylate-based fiber, and the flameproof spun yarn is characterized in that it contains 1 to 30 wt % of the polyarylate-based fiber relative to the total weight of the flameproof spun yarn.

It is preferable that the flameproof spun yarn of the present invention includes further a naturally derived fiber, and the flameproof spun yarn contains 15 to 95 wt % of the modacrylic fiber containing an antimony compound, 1 to 30 wt % of the polyarylate-based fiber, and 4 to 84 wt % of the naturally derived fiber relative to the total weight of the flameproof spun yarn. Furthermore, in the flameproof spun yarn of the present invention, an acrylonitrile-based copolymer constituting the modacrylic fiber includes 35 to 65 wt % of a monomer of halogen-containing vinyl and/or a halogen-containing vinylidene relative to the total weight of the acrylonitrile-based copolymer, and the monomer of halogen-containing vinyl and/or halogen-containing vinylidene is at least one monomer selected from the group consisting of vinyl chloride, vinylidene chloride, vinyl bromide and vinylidene bromide. Further it is preferable that the flameproof spun yarn of the present invention includes 3 wt % or more of the antimony compound relative to the total weight of the flameproof spun yarn. Further in the flameproof spun yarn of the present invention, it is preferable that the antimony compound is at least one compound selected from the group consisting of antimony trioxide, antimony tetroxide and antimony pentoxide. Further in the flameproof spun yarn of the present invention, it is preferable that the polyarylate-based fiber is a fiber obtained from wholly aromatic polyester including 50 mol % or more of a moiety of repeating constitutional units represented by General formula (P) and General formula (Q) below. Further, the flameproof spun yarn of the present invention includes a para-aramid fiber, and the flameproof spun yarn may contain 0 to 4 wt % of the para-aramid fiber relative to the total weight of the flameproof spun yarn.

[Chemical formula 1]

(P)

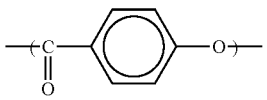

(Q)

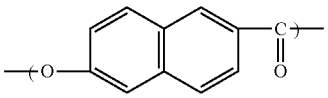

A flameproof fabric of the present invention includes a modacrylic fiber containing an antimony compound and a polyarylate-based fiber, and the flameproof fabric is characterized in that it contains 1 to 30 wt % of the polyarylate-based fiber relative to the total weight of the flameproof fabric.

It is preferable that the flameproof fabric of the present invention includes further a naturally derived fiber, and it contains 15 to 95 wt % of the modacrylic fiber containing an antimony compound, 1 to 30 wt % of the polyarylate-based fiber, and 4 to 84 wt % of the naturally derived fiber relative to the total weight of the flameproof fabric. Furthermore, it is preferable in the flameproof fabric of the present invention that an acrylonitrile-based copolymer constituting the modacrylic fiber includes 35 to 65 wt % of a monomer of halogen-containing vinyl and/or a halogen-containing vinylidene relative to the total weight of the acrylonitrile-based copolymer, and the monomer of halogen-containing vinyl and/or halogen-containing vinylidene is at least one monomer selected from the group consisting of vinyl chloride, vinylidene chloride, vinyl bromide and vinylidene bromide. Further it is preferable that the flameproof fabric of the present invention includes 3 wt % or more of the antimony compound relative to the total weight of the flameproof fabric. Further in the flameproof fabric of the present invention, it is preferable that the antimony compound is at least one compound selected from the group consisting of antimony trioxide, antimony tetroxide and antimony pentoxide. Further in the flameproof fabric of the present invention, it is preferable that the polyarylate-based fiber is a fiber obtained from wholly aromatic polyester including 50 mol % or more of a moiety of repeating constitutional units represented by General formula (P) and General formula (Q) above. Further, in the flameproof fabric of the present invention, it is preferable that a char length measured by a flameproofness test based on ASTM D6413-08 is 6 inches or less, and it is further preferable that the char length is 4 inches or less. Further, the flameproof fabric of the present invention includes a para-aramid fiber, and the flameproof fabric may contain 0 to 4 wt % of the para-aramid fiber relative to the total weight of the flameproof fabric.

Clothes of the present invention are characterized in that they include the above-mentioned flameproof fabric.

Flameproof work clothes of the present invention are characterized in that they include the above-mentioned flameproof fabric.

Effects of the Invention

In the present invention, a modacrylic fiber containing an antimony compound and a polyarylate-based fiber are used together in a spun yarn or a fabric, and the polyarylate-based fiber is contained in the range of 1 to 30 wt % so as to provide flameproof work clothes having an excellent designability and flameproofness by use of the spun yarn or the fabric. For example, it is possible to provide at a lower cost flameproof work clothes having excellent flameproofness that reduce the char length (length of carbonized part) as measured by a flameproofness test based on ASTM (American Society for Testing Materials) D6413-08 so as to put a safe product into widespread use. Moreover, the flameproof work clothes of the present invention have an excellent designability to allow the expression of light colors after dyeing, and thus they can provide sufficient flameproofness to various kinds of flameproof work clothes that are required to have various colors for each company.

DESCRIPTION OF THE INVENTION

The inventors unexpectedly have found that a spun yarn, a fabric, clothes and flameproof work clothes having excellent flameproofness and designability can be provided by combining a polyarylate-based fiber and a modacrylic fiber containing an antimony compound, although the polyarylate-based fiber has been considered to be inferior in flameproofness to a para-aramid fiber, thereby achieving the present invention.

Specifically, by use of a polyarylate-based fiber of light-yellow color, an excellent designability was achieved, namely, light colors were expressed after dyeing. Further, even for a fabric that uses the polyarylate-based fiber, by combining it with a modacrylic fiber that emits a fire-extinguishing gas at the time of flame contact, ignition to the fabric was suppressed, and the char length as an index for flameproofness was reduced further in comparison with a case of using a para-aramid fiber. As a result, when compared to a case where a para-aramid fiber is used, the rate of the fibers having high strength and high heat resistance in the fabric could be reduced, and thus, flameproof work clothes having excellent flameproofness were provided at a lower cost.

In the present invention, the flameproofness can be evaluated with reference to the char length measured by a flameproofness test based on ASTM D6413-08. Preferably, when the char length is 6 inches or less, the flameproofness is recognized, and a smaller value of the char length indicates excellent flameproofness. In a case of a spun yarn, the flameproofness can be evaluated by using a fabric fabricated from the spun yarn as a measurement sample. Furthermore in the present invention, the designability can be evaluated with reference to the expression level of the light-color hue after a dyeing process. Specifically, the designability can be evaluated by either a function evaluation or by measuring the chromaticity on the basis of the HunterLab colorimetric system.

(Flameproof Spun Yarn)

First, a flameproof spun yarn will be described below as Embodiment 1 of the present invention. The flameproof spun yarn of the present invention includes a modacrylic fiber containing an antimony compound and a polyarylate-based fiber.

The modacrylic fiber is obtained from an acrylonitrile-based copolymer formed by copolymerizing 35 to 85 wt % of acrylonitrile and 15 to 65 wt % of another component(s). It is more preferable that the content of the acrylonitrile in the acrylonitrile-based copolymer is 35 to 65 wt %. Examples of the other components include a monomer of halogen-containing vinyl and/or halogen-containing vinylidene. It is more preferable that the content of the monomer of halogen-containing vinyl and/or halogen-containing vinylidene in the acrylonitrile-based copolymer is 35 to 65 wt %. An example of the other component(s) is a monomer that contains a sulfonic acid group. In the acrylonitrile-based copolymer, it is preferable that the content of the monomer containing a sulfonic acid group is 0 to 3 wt %.

When the content of the acrylonitrile in the acrylonitrile-based copolymer is 35 wt % or more, a spun yarn having sufficient heat resistance is obtained. When the content of the acrylonitrile is 85 wt % or less, a spun yarn having sufficient flameproofness is obtained.

When the content of the monomer of halogen-containing vinyl and/or halogen-containing vinylidene in the acrylonitrile-based copolymer is 15 wt % or more, a spun yarn having sufficient flameproofness is obtained. When the content of the monomer of halogen-containing vinyl and/or halogen-containing vinylidene is 65 wt % or less, a spun yarn having sufficient heat resistance is obtained.

Examples of the monomer of halogen-containing vinyl and/or halogen-containing vinylidene include vinyl chloride, vinylidene chloride, vinyl bromide, vinylidene bromide and the like. One or more than one of these examples can be used.

Examples of the monomer containing a sulfonic acid group include methacrylic sulfonic acid, allyl sulfonic acid, styrene sulfonic acid, 2-acrylamide-2-methylpropanesulfonic acid, and the salts thereof and the like. One or more than one of these examples can be used. In the above description, examples of the salts include sodium salt, potassium salt, ammonium salt and the like, though the salts are not limited to these examples. The monomer containing a sulfonic acid group is used as required. Excellent production stability in the spinning step is achieved if the content of the monomer containing a sulfonic acid group in the acrylonitrile-based copolymer is 3 wt % or less.

Examples of the antimony compound that may be included in the modacrylic fiber include antimony trioxide, antimony tetroxide, antimony pentoxide, antimonic acid and the salts thereof, antimony oxychloride and the like. One or more than one of these examples can be used. Among them, from the viewpoint of production stability in the spinning step, one or more compound(s) selected from the group consisting of antimony trioxide, antimony tetroxide, and antimony pentoxide is used favorably.

For the acrylic fiber containing an antimony compound, for example, any commercially available products such as PROTEX™ (registered trade name; an acrylic fiber) type-M, type-C or the like manufactured by KANEKA Corporation can be used.

The polyarylate-based fiber is obtained from a polymer that is a long-chain synthetic polymer whose monomers are all aromatic compounds and that exhibits a thermotropic liquid crystal property. Though there is no particular limitation for the chemical structure as long as the liquid crystal polymers can be melt-cast, for example, thermoplastic liquid crystal polyester (including also thermoplastic liquid crystal polyester amid provided by introducing thereto an amide bond) or the like can be used. It is possible to introduce into aromatic polyester or aromatic polyester amide further any bonding or the like derived from isocyanate, such as an imide bond, a carbonate bond, a carbodiimide bond or an isocyanurate bond.

It is preferable that the thermoplastic liquid crystal polyester is wholly aromatic polyester including 50 mol % or more of a moiety of repeating constitutional units represented by General formula (P) and General formula (Q) below. More preferably, it includes 55 to 95 mol %, and further preferably 60 to 90 mol % of the moiety. When the content of the moiety of repeating constitutional units represented by General formula (P) and General formula (Q) in the thermoplastic liquid crystal polyester is 50 mol % or more, excellent production stability in the spinning step is achieved.

In the thermoplastic liquid crystal polyester, it is preferable that the molar ratio between the repeating constitutional unit represented by General formula (P) below and the repeating constitutional unit represented by General formula (Q) below, i.e., (P):(Q)=100:1 to 100:50. More preferably, (P):(Q) =100:1 to 100:45, and further preferably (P):(Q)=100:1 to 100:40. When the molar ratio between the repeating constitutional unit represented by General formula (P) and the repeating constitutional unit represented by General formula (Q), i.e., (P):(Q)=100:1 to 100:50, excellent production stability in the spinning step is achieved.

[Chemical formula 2]

(P)

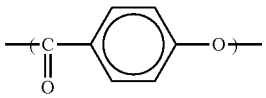

(Q)

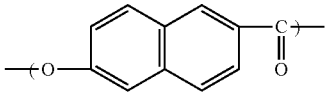

In the thermoplastic liquid crystal polyester, a thermoplastic polymer such as polyethylene terephthalate, modified polyethylene terephthalate, polyolefin, polycarbonate, polyarylate, polyamide, polyphenylene sulfide, polyester ether-ketone, fluororesin and the like can be mixed in a range not sacrificing the effect of the present invention. Furthermore, filler or various additives may be contained. Examples of the additives include a plasticizer, a photostabilizer, a weather-proof-stabilizer, an antioxidant, an ultraviolet absorber, an antistatic agent, a flame retardant, dye-pigment, a lubricant, a viscosity modifier and the like.

It is preferable that the single fiber fineness of the polyarylate-based fiber is 1 to 20 dtex, more preferably 1.5 to 15 dtex, and further preferably 2 to 10 dtex. The single fiber fineness of the polyarylate-based fiber is decided appropriately with reference to the balance with the other materials to be combined, and a smaller fineness is preferred from the viewpoint of reinforcing the strength. And the single fiber fineness of each fiber constituting a long fiber (filament) and/or a short fiber (staple) may be equivalent to or different from each other.

An example of the polyarylate-based fiber that can be applied to the present invention is VECTRAN™ (registered trade name; a polyarylate-based fiber) manufactured by Kuraray Co., Ltd.

The flameproof spun yarn includes 1 to 30 wt % of the polyarylate-based fiber. When the content of the polyarylate-based fiber is 1 to 30 wt %, a spun yarn having sufficient flameproofness is obtained. From the viewpoint of flameproofness and cost reduction, the flameproof spun yarn includes preferably 3 to 28 wt %, and more preferably 5 to 25 wt % of the polyarylate-based fiber.

It is preferable that, in the flameproof spun yarn, the content of the modacrylic fiber containing an antimony compound is 15 to 95 wt %. More preferably, it is 20 to 88 wt %, further preferably 30 to 80 wt %, even further preferably 33 to 70 wt %, particularly preferably 34 to 60 wt %, and most preferably 35 to 55 wt %. When the content of the modacrylic fiber containing an antimony compound is 15 wt % or more, a spun yarn having sufficient flameproofness is obtained. And when the content of the modacrylic fiber containing an antimony compound is 95 wt % or less, the heat resistance of the spun yarn of the present invention is improved.

The flameproof spun yarn may include any other fibers than the modacrylic fiber containing an antimony compound and the polyarylate-based fiber in a range not hindering the effect of the present invention. Examples of the other fibers include a naturally derived fiber, a synthetic fiber and the like. Though there is no particular limitation, examples of the synthetic fiber include an aliphatic polyamide-based fiber such as a Nylon 66 fiber; a meta-aramid fiber; an acrylic fiber; a polyester fiber such as a polyethylene terephthalate (PET) fiber, a polytrimethylene terephthalate (PTT) fiber, and a polybutylene terephthalate (PBT) fiber; a polyolefin-based fiber such as a polyethylene fiber; a polyvinyl alcohol-based fiber such as a vinylon fiber; a polyvinyl chloride-based fiber such as a polyvinyl chloride fiber; a polyurethane fiber; a polyoxymethylene fiber; a polytetrafluoroethylene (PTFE) fiber; a polyphenylene sulfide (PPS) fiber; a melamine fiber; a polysulfonamide (PSA) fiber and the like. The naturally derived fibers will be described later. The content of the other fiber in the flameproof spun yarn can be adjusted appropriately in a range not to hinder the effect of the present invention. In a case where the flameproof spun yarn includes a para-aramid fiber as the other fiber, from the viewpoint of ensuring the designability, preferably the content of the para-aramid fiber in the flameproof spun yarn is 0 to 4 wt %, and more preferably 0 to 3 wt %.

For improving the moisture absorbency and permeability, the flexibility and the touch, the flameproof spun yarn may include further a naturally derived fiber. In the present invention, a naturally derived fiber indicates a natural fiber and a chemical fiber manufactured from natural materials. Examples of chemical fibers manufactured from natural materials include a semisynthetic fiber and a regenerated fiber. Though there is no particular limitation, examples of the naturally derived fibers include: natural fibers such as cotton, flax, ramie, silk, wool and the like; semisynthetic fibers such as acetate fiber; and regenerated fibers such as rayon, lyocell and the like. The naturally derived fiber may be a cellulosic fiber such as cotton, flax, ramie, acetate fiber, rayon, flame-retardant rayon, lyocell and the like, or may be a protein fiber such as silk, wool and the like, without any particular limitation to these examples. Among them, cellulosic fibers such as cotton, flax, ramie, acetate fiber, rayon, flame-retardant rayon, lyocell and the like are used favorably from the viewpoint of providing excellent texture and moisture absorbency and permeability. These naturally derived fibers may be used alone or in combination of two or more.

It is preferable that the content of the naturally derived fiber included in the flameproof spun yarn is 4 to 84 wt %. More preferably it is 9 to 77 wt %, further preferably 15 to 65 wt %, even further preferably 20 to 50 wt %, and particularly preferably 25 to 45 wt %. When the content of the naturally derived fiber is 4 wt % or more, a spun yarn having sufficient comfort is obtained. When the content of the naturally derived fiber is 84 wt % or less, a spun yarn having sufficient flameproofness is obtained.

From the viewpoint of excellent flameproofness and designability and also favorable moisture absorbency and permeability, flexibility, touch and the like, it is preferable that the flameproof spun yarn contains 15 to 95 wt % of the modacrylic fiber containing an antimony compound, 1 to 30 wt % of the polyarylate-based fiber, and 4 to 84 wt % of the naturally derived fiber relative to the total weight of the flameproof spun yarn. More preferably, it contains 20 to 88 wt % of the modacrylic fiber containing an antimony compound, 3 to 28 wt % of the polyarylate-based fiber, and 9 to 77 wt % of the naturally derived fiber relative to the total weight of the flameproof spun yarn. Further preferably, it contains 30 to 80 wt % of the modacrylic fiber containing an antimony compound, 5 to 25 wt % of the polyarylate-based fiber, and 15 to 65 wt % of the naturally derived fiber relative to the total weight of the flameproof spun yarn.

It is preferable that the flameproof spun yarn contains 3 wt % or more of the antimony compound relative to the total weight of the spun yarn. More preferably, the content is 3.2 wt % or more, and further preferably 3.6 wt % or more. When the content of the antimony compound is 3 wt % or more, a spun yarn having sufficient flameproofness is obtained. Though there is no particular upper limit for the content of the antimony compound in the flameproof spun yarn, from the viewpoint of yarn strength of the spun yarn, it is preferably 33 wt % or less relative to the total weight of the flameproof spun yarn, and more preferably, 21 wt % or less.

The flameproof spun yarn of the present invention can be manufactured by a well-known spinning process. Though examples of the spinning process include ring spinning, open end spinning, air jet spinning and the like, the examples are not limiting. The above-described fibers may be used as a long fiber (filament) and/or a short fiber (staple).

(Flameproof Fabric)

Hereinafter a flameproof fabric will be explained as Embodiment 2 of the present invention. The flameproof fabric includes a modacrylic fiber containing an antimony compound and a polyarylate-based fiber.

For the modacrylic fiber included in the flameproof fabric, a modacrylic fiber obtained from the acrylonitrile-based copolymer explained in the above Embodiment 1 can be used.

When the content of the acrylonitrile in the acrylonitrile-based copolymer is 35 wt % or more, a fabric having sufficient heat resistance is obtained. When the content of the acrylonitrile is 85 wt % or less, a fabric having sufficient flameproofness is obtained.

When the content of the monomer of halogen-containing vinyl and/or halogen-containing vinylidene in the acrylonitrile-based copolymer is 15 wt % or more, a fabric having sufficient flameproofness is obtained. When the content of the monomer of halogen-containing vinyl and/or halogen-containing vinylidene is 65 wt % or less, a fabric having sufficient heat resistance is obtained.

For the polyarylate-based fiber included in the flameproof fabric, the polyarylate-based fiber explained in the above Embodiment 1 can be used.

The flameproof fabric includes 1 to 30 wt % of the polyarylate-based fiber. When the content of the polyarylate-based fiber is 1 to 30 wt %, a fabric having sufficient flameproofness is obtained. From the viewpoint of flameproofness and cost reduction, the flameproof fabric includes preferably 3 to 28 wt %, and more preferably 5 to 25 wt % of the polyarylate-based fiber.

It is preferable that the content of the modacrylic fiber containing an antimony compound in the flameproof fabric is 15 to 95 wt %. More preferably, it is 20 to 88 wt %, further preferably 30 to 80 wt %, even further preferably 33 to 70 wt %, particularly preferably 34 to 60 wt %, and most preferably 35 to 55 wt %. When the content of the modacrylic fiber containing an antimony compound is 15 wt % or more, a fabric having sufficient flameproofness is obtained. And when the content of the modacrylic fiber containing an antimony compound is 95 wt % or less, the heat resistance of the fabric of the present invention is improved.

The flameproof fabric may include any fibers other than the modacrylic fiber containing an antimony compound and the polyarylate-based fiber in a range not hindering the effect of the present invention. Examples of the other fibers include a naturally derived fiber, a synthetic fiber and the like. Though there is no particular limitation, examples of the synthetic fiber include an aliphatic polyamide-based fiber such as a Nylon 66 fiber; a meta-aramid fiber; an acrylic fiber; a polyester fiber such as a polyethylene terephthalate (PET) fiber, a polytrimethylene terephthalate (PTT) fiber, and a polybutylene terephthalate (PBT) fiber; a polyolefin-based fiber such as a polyethylene fiber; a polyvinyl alcohol-based fiber such as a vinylon fiber; a polyvinyl chloride-based fiber such as a polyvinyl chloride fiber; a polyurethane fiber; a polyoxymethylene fiber; a polytetrafluoroethylene (PTFE) fiber; a polyphenylene sulfide (PPS) fiber; a melamine fiber; a polysulfonamide (PSA) fiber and the like. The naturally derived fibers will be described later. The content of the other fiber in the flameproof fabric can be adjusted appropriately in a range not to hinder the effect of the present invention. In a case where the flameproof fabric includes a para-aramid fiber as the other fiber, from the viewpoint of ensuring the designability, preferably the content of the para-aramid fiber in the flameproof fabric is 0 to 4 wt %, and more preferably 0 to 3 wt %.

For improving the moisture absorbency and permeability, the flexibility and the touch, the flameproof fabric may include further a naturally derived fiber. For the naturally derived fiber, the naturally derived fiber as mentioned in the above Embodiment 1 can be used.

It is preferable that the content of the naturally derived fiber included in the flameproof fabric is 4 to 84 wt %. More preferably, it is 9 to 77 wt %, further preferably 15 to 65 wt %, and even further preferably 20 to 50 wt %. When the content of the naturally derived fiber is 4 wt % or more, a fabric having sufficient comfort is obtained. And when the content of the naturally derived fiber is 84 wt % or less, a fabric having sufficient flameproofness is obtained.

From the viewpoint of excellent flameproofness and designability and also favorable moisture absorbency and permeability, flexibility and touch, it is preferable that the flameproof fabric contains 15 to 95 wt % of the modacrylic fiber containing an antimony compound, 1 to 30 wt % of the polyarylate-based fiber, and 4 to 84 wt % of the naturally derived fiber relative to the total weight of the flameproof fabric. More preferably, it contains 20 to 88 wt % of the modacrylic fiber containing an antimony compound, 3 to 28 wt % of the polyarylate-based fiber, and 9 to 77 wt % of the naturally derived fiber relative to the total weight of the flameproof fabric. Further preferably, it contains 30 to 80 wt % of the modacrylic fiber containing an antimony compound, 5 to 25 wt % of the polyarylate-based fiber, and 15 to 65 wt % of the naturally derived fiber relative to the total weight of the flameproof fabric.

It is preferable that the flameproof fabric contains 3 wt % or more of the antimony compound relative to the total weight of the fabric. More preferably the content is 3.2 wt % or more, and further preferably 3.6 wt % or more. When the content of the antimony compound is 3 wt % or more, a fabric having sufficient flameproofness is obtained. Though there is no particular upper limit for the content of the antimony compound in the flameproof fabric, from the viewpoint of tear strength and tensile strength, it is preferably 33 wt % or less relative to the total weight of the flameproof fabric, and more preferably, 21 wt % or less.

In the flameproof fabric, though there is no particular limitation, from the viewpoint of tear strength and tensile strength, the fineness of the modacrylic fiber containing an antimony compound is preferably 1 to 20 dtex, and more preferably 1.5 to 15 dtex. The fineness of the polyarylate-based fiber is preferably 1 to 20 dtex, and more preferably 1.5 to 15 dtex, and the fineness of the naturally derived fiber is preferably 0.5 to 20 dtex, and more preferably 1 to 15 dtex. In the flameproof fabric, though there is no particular limitation, from the viewpoint of tear strength and tensile strength, the fiber length of the modacrylic fiber containing an antimony compound is preferably 38 to 127 mm, and more preferably 38 to 76 mm. The fiber length of the polyarylate-based fiber is preferably 38 to 127 mm, and more preferably 38 to 76 mm, and the fiber length of the naturally derived fiber is preferably 15 to 152 mm, and more preferably 20 to 127 mm. Furthermore, though there is no particular limitation, from the viewpoint of flexibility and touch, it is preferable that the weight per unit area of the flameproof fabric is 100 to 500 g/m$^2$, more preferably 150 to 400 g/m$^2$, and further preferably 200 to 300 g/m$^2$.

The flameproof fabric of the present invention can be manufactured by a well-known fabric formation method. Examples of the form of the fabric include a woven fabric, a knitted fabric, a nonwoven fabric and the like, though the present invention is not limited to these examples. The woven fabric may be manufactured by mixed weaving, and the knitted fabric may be manufactured by mixed knitting. Furthermore, the flameproof spun yarn may be used to manufacture a flameproof fabric.

The structure of the woven fabric is not limited in particular, but it may be a three foundation weave such as a plain weave, a twill weave, satin weave or the like, or it may be a patterned woven fabric fabricated by using a special loom such as a Dobby loom or Jacquard loom. Similarly, the structure of the knitted fabric is not limited in particular, but it may be any of circular knitting, flat knitting or warp knitting. Examples of the form of the nonwoven fabric include a wet-laid nonwoven fabric, a carded nonwoven fabric, an air-laid nonwoven fabric, a thermal bonded nonwoven fabric, a chemical bonded nonwoven fabric, a needle-punched nonwoven fabric, a hydro-entangled nonwoven fabric, a stitch-bonded nonwoven fabric and the like.

The flameproof fabric of the present invention has excellent flameproofness, and preferably its char length measured by a flameproofness test based on ASTM D6413-08 is 6 inches or less, and more preferably its char length measured by a flameproofness test based on ASTM D6413-08 is 4 inches or less.

(Clothes and Flameproof Work Clothes)

The clothes of the present invention are formed of the above-described flameproof fabric, and they can be manufactured by a well-known sewing process using the flameproof fabric. As the flameproof fabric has excellent flameproofness, the clothes of the present invention formed of the flameproof fabric can be used favorably as flameproof work clothes. It is possible to use the flameproof fabric of a single layer in order to constitute single-layered flameproof work clothes. It is also possible to use two or more layers of the flameproof fabric of the present invention in order to constitute multi-layered flameproof work clothes. Furthermore, it is possible to use the flameproof fabric to form a multi-layer with any other fabric(s) in order to constitute multi-layered flameproof work clothes. Furthermore, since the flameproof fabric has not only excellent designability and flameproofness but excellent wear resistance and toughness, flameproof work clothes having excellent wear resistance can be provided, and also flameproof work clothes having excellent cut resistance can be provided. In addition, the flameproofness is maintained even after repeated washing.

EXAMPLES

The present invention will be described below more specifically with reference to Examples, though the present invention is not limited to these Examples.

First, the methods for measuring the flameproofness and evaluating the designability in Examples are indicated below.

(Flameproofness)

The char length (length of carbonized part) as an index for flameproofness was measured in accordance with a flameproofness test based on ASTM (American Society for Testing Materials) D6413-08.

(Designability)

The designability of the fabric after dyeing was subjected to a function evaluation and classified into three levels of A to C in accordance with the criterion mentioned below.

A: The hue of light color is expressed sufficiently, and there is no noticeable fuzzes of fibers of different colors on the fabric surface.

B: Though the hue of light color is expressed, fuzzes of fibers of different colors are slightly noticeable on the fabric surface.

C: The hue of light color is not expressed, and fuzzes of fibers of different colors are noticeable on the fabric surface.

For the fibers, the following materials were used.

(1) The acrylic fiber containing an antimony compound was: an acrylic fiber prepared from an acrylonitrile-based copolymer composed of 50 wt % of acrylonitrile, 49 wt % of vinylidene chloride and 1 wt % of sodium styrenesulfonate to which antimony trioxide was added to be 10 wt % relative to the total weight of the acrylonitrile-based copolymer (fineness: 1.7 dtex, fiber length: 38 mm, hereinafter referred to also as "PC"); and an acrylic fiber prepared from an acrylonitrile-based copolymer composed of 50 wt % of acrylonitrile, 49 wt % of vinylidene chloride and 1 wt % of sodium styrenesulfonate to which antimony trioxide was added to be 25 wt % relative to the total weight of the acrylonitrile-based copolymer (fineness: 2.2 dtex, fiber length: 38 mm, hereinafter referred to also as "PM").

(2) The polyarylate-based fiber was VECTRAN™ (registered trade name; a polvarylate-based fiber; fineness: 2.8 dtex, fiber length: 38 mm, hereinafter, referred to also as "VEC") manufactured by Kuraray Co., LTD.

(3) The other fibers were: a Nylon66 fiber (fineness: 1.3 dtex, fiber length: 38 mm, hereinafter referred to also as "NY66"); cotton (combed cotton available in the market, hereinafter referred to also as "COT"); LENZING FR™ (registered trade name; a flame retardant rayon fiber; fineness: 2.2 dtex, fiber length: 51 mm, hereinafter referred to also as "LFR") manufactured by Lenzing AG; and TWARON™ (registered trade name; a para-aramid fiber; fineness: 1.7 dtex, fiber length: 40 mm, hereinafter referred to also as "TWA") manufactured by Teijin Limited.

Reference Examples 1-2

In Reference examples 1-2, short fibers of the compositions indicated in Table 1 below were mixed to fabricate a nonwoven fabric of weight per unit area of 150 g/m$^2$ by a needle-punching process for fabricating a nonwoven fabric. The obtained fabric (needle-punched nonwoven fabric) was used to perform a flameproofness test based on ASTM D6413-08, the char length was measured and the results are illustrated in Table 1 below. Table 1 below illustrates also the afterflame time (second) measured by the flameproofness test based on ASTM D6413-08. Table 1 below shows that the polyarylate-based fiber employed alone is inferior in the flameproofness to the para-aramid fiber.

TABLE 1

| | Fiber composition (wt %) | | Flameproofness test | |
|---|---|---|---|---|
| | TWA | VEC | Afterflame time (sec) | Char length (in) |
| Ref. 1 | 100 | — | 0 | 0.5 |
| Ref. 2 | — | 100 | 134 | 12.0 |

Note:
Ref. indicates Reference example.

Examples 1-3, Comparative Examples 1-5

In Examples 1-3 and Comparative examples 1-5, short fibers were mixed to provide fiber compositions as illustrated in Table 2 below, a spun yarn was fabricated by ring spinning, and the obtained spun yarn was used to fabricate a knitted fabric. The spun yarn was a blended yarn of English cotton count of 20, and the knitted fabric had a single jersey structure and the weight per unit area was 200 g/m$^2$. After scouring and bleaching the obtained fabric (knitted fabric), the fabric was dyed to light blue by use of 0.01 wt % of Maxilon Blue GRL (300%) (manufactured by HUNTSMAN Corporation) relative to the weight of the modacrylic fiber. By using the fabric after dyeing, a flameproofness test based on ASTM D6413-08 was performed. Further, the designability of the fabric after dyeing was evaluated. The results are illustrated in Table 2 below. In Table 2, the contents of the antimony compound in the fabric (hereinafter, it is referred also to as Sb content in fabric) are also illustrated.

TABLE 2

| | Fiber composition (wt %) | | | | | | Char length | | Sb content in fabric |
|---|---|---|---|---|---|---|---|---|---|
| | PM | PC | NY66 | COT | TWA | VEC | (in) | Designability | (wt %) |
| Ex.1 | — | 50 | 10 | 39 | — | 1 | 4.3 | A | 4.5 |
| Ex.2 | 50 | — | 10 | 35 | — | 5 | 3.9 | A | 10 |
| Ex.3 | — | 50 | 10 | 30 | — | 10 | 3.7 | A | 4.5 |
| Com.1 | 50 | — | 10 | 40 | — | — | 5.2 | A | 10 |
| Com.2 | 50 | — | 10 | 35 | 5 | — | 4.8 | B | 10 |
| Com.3 | — | 50 | 10 | 35 | 5 | — | 4.9 | B | 4.5 |
| Com.4 | 50 | — | 10 | 30 | 10 | — | 4.5 | C | 10 |
| Com.5 | — | 50 | 10 | 30 | 10 | — | 4.5 | C | 4.5 |

Note: Ex. and Com. indicate Example and Comparative example respectively.

Table 2 shows that when a modacrylic fiber containing an antimony compound is included, a fabric using the polyarylate-based fiber has flameproofness superior to that of a fabric using a para-aramid fiber. In particular, as shown from the comparison between Example 1 and Comparative example 5, in a case where the content of the blended polyarylate-based fiber is smaller than the content of the blended para-aramid fiber, the flameproofness is further favorable. And as shown from the comparison between Example 1 and Example 2, when the content of the polyarylate-based fiber is 5 wt % or more relative to the total weight of the flameproof fabric, the char length measured by the flameproofness test based on ASTM D6413-08 is 4 inches or less, i.e., the flameproofness is more favorable. It has been clarified also that a fabric using the polyarylate-based fiber is excellent for designability.

Examples 4-5, Comparative Examples 6-8

In Examples 4-5 and Comparative examples 6-8, short fibers were mixed to provide fiber compositions as illustrated in Table 3 below, a spun yarn was fabricated by ring spinning, and the obtained spun yarn was used to fabricate a woven fabric by use of a well-known weaving method. The spun yarn was a blended yarn of English cotton count of 20, and the woven fabric was a twill weave and the weight per unit area was 210 g/m$^2$. After scouring and bleaching the obtained fabric (woven fabric), the fabric was dyed to light blue by use of 0.01 wt % of Maxilon Blue GRL (300%) (manufactured by HUNTSMAN Corporation) relative to the weight of the modacrylic fiber. By using the fabric after dyeing, a flameproofness test based on ASTM D6413-08 was performed. Further, the designability of the fabric after dyeing was evaluated. The results are illustrated in Table 3 below. In Table 3, the Sb contents in the fabric are also illustrated.

TABLE 3

| | Fiber composition (wt %) | | | | Char length | | Sb content in fabric |
|---|---|---|---|---|---|---|---|
| | PC | LFR | TWA | VEC | (in) | Designability | (wt %) |
| Ex.4 | 50 | 30 | — | 20 | 2.9 | A | 4.5 |
| Ex.5 | 40 | 30 | — | 30 | 2.8 | A | 3.6 |
| Com.6 | 50 | 30 | 20 | — | 3.5 | C | 4.5 |
| Com.7 | 40 | 30 | 30 | — | 3.2 | C | 3.6 |
| Com.8 | 30 | 30 | — | 40 | 7.6 | A | 2.7 |

Table 3 shows that when a modacrylic fiber containing an antimony compound is included, a fabric using the polyarylate-based fiber in a range lower than 40 wt % has flameproofness superior to that of a fabric using a para-aramid fiber. It has been clarified also that a fabric using the polyarylate-based fiber is excellent at designability.

The fabrics (woven fabrics) obtained in Example 4 and Comparative example 7 were scoured and bleached, and then dyed to light blue as mentioned above. The fabrics after dyeing were used to measurement of chromaticity (Hunter-Lab colorimetric system) with "Spectrophotometer CM-2600d" manufactured by Konica Minolta, Inc. The result is illustrated in Table 4 below.

TABLE 4

| | | | | | Chromaticity (HunterLab colorimetric system) | | | | | |
|---|---|---|---|---|---|---|---|---|---|---|
| | Fiber composition (wt %) | | | | After scouring and bleaching | | | After dyeing to light blue | | |
| | PC | LFR | TWA | VEC | L | a | b | L | a | b |
| Ex.4 | 50 | 30 | — | 20 | 91.9 | 0.2 | 7.0 | 71.0 | −11.7 | −17.2 |
| Com.7 | 40 | 30 | 30 | — | 91.4 | −4.1 | 21.4 | 70.9 | −18.8 | −4.7 |

Table 4 above shows that the light blue color was expressed vividly in the fabric of Example 4 using the polyarylate-based fiber, which demonstrates its excellence at designability. On the other hand, in the fabric of Comparative example 7 using the para-aramid fiber, as the inherent yellow color of the para-aramid fiber remained without being bleached, the hue of light blue could not be expressed and the textile possessed a light green color, namely, the designability was not favorable.

The invention claimed is:

1. A flame resistant spun yarn having flame resistance, comprising:

a modacrylic fiber comprising an antimony compound; and a polyarylate-based fiber, wherein the flame resistant spun yarn contains from 1 to 30 wt % of the polyarylate-based fiber relative to a total weight of the flame resistant spun yarn.

2. The flame resistant spun yarn according to claim 1, wherein the flame resistance spun yarn further comprises a naturally derived fiber, and the flame resistant spun yarn contains from 15 to 95 wt % of the modacrylic fiber comprising an antimony compound, from 1 to 30 wt % of the polyarylate-based fiber, and from 4 to 84 wt % of the naturally derived fiber, relative to the total weight of the flame resistant spun yarn.

3. The flame resistant spun yarn according to claim 1, wherein an acrylonitrile-based copolymer forming the modacrylic fiber comprises from 35 to 65 wt % of at least one monomer selected from the group consisting of a monomer of halogen-containing vinyl and a monomer of halogen-containing vinylidene, relative to a total weight of the acrylonitrile-based copolymer, and the monomer of the at least one monomer is at least one monomer selected from the group consisting of vinyl chloride, vinylidene chloride, vinyl bromide, and vinylidene bromide.

4. The flame resistant spun yarn according to claim 1, wherein the flame resistant spun yarn comprises 3 wt % or more of the antimony compound relative to the total weight of the flame resistant spun yarn.

5. The flame resistant spun yarn according to claim 1, wherein the antimony compound is at least one compound selected from the group consisting of antimony trioxide, antimony tetroxide and antimony pentoxide.

6. The flame resistant spun yarn according to claim 1, wherein the polyarylate-based fiber is a fiber obtained from wholly aromatic polyester comprising 50 mol % or more of a moiety of repeating constitutional units represented by formula (P) and formula (Q) below, (P)

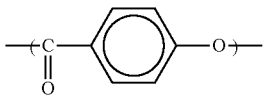

(Q)

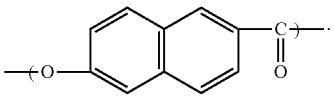

(Q)

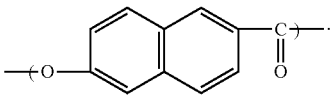

7. The flame resistant spun yarn according to claim 1, wherein the flame resistant spun yarn further comprises a para-aramid fiber in an amount of no more than 4 wt % relative to the total weight of flame resistant spun yarn.

8. A flame resistant fabric having flame resistance, wherein the flame resistant fabric comprises a modacrylic fiber comprising an antimony compound and a polyarylate-based fiber, and the flame resistant fabric contains from 1 to 30 wt % of the polyarylate-based fiber relative to a total weight of the flame resistant fabric.

9. The flame resistant fabric according to claim 8, wherein the flame resistant fabric further comprises a naturally derived fiber, and the flame resistant fabric contains from 15 to 95 wt % of the modacrylic fiber comprising an antimony compound, from 1 to 30 wt % of the polyarylate-based fiber, and from 4 to 84 wt % of the naturally derived fiber, relative to the total weight of the flame resistant fabric.

10. The flame resistant fabric according to claim 8, wherein an acrylonitrile-based copolymer forming the modacrylic fiber comprises from 35 to 65 wt % of at least one monomer selected from the group consisting of a monomer of halogen-containing vinyl and a monomer of halogen-containing vinylidene, relative to a total weight of the acrylonitrile-based copolymer, and the at least one monomer is at least one monomer selected from the group consisting of vinyl chloride, vinylidene chloride, vinyl bromide, and vinylidene bromide.

11. The flame resistant fabric according to claim 8, wherein the flame resistant fabric comprises 3 wt % or more of the antimony compound relative to the total weight of the flame resistant fabric.

12. The flame resistant fabric according to claim 8, wherein the antimony compound is at least one compound selected from the group consisting of antimony trioxide, antimony tetroxide and antimony pentoxide.

13. The flame resistant fabric according to claim 8, wherein the polyarylate-based fiber is a fiber obtained from wholly aromatic polyester comprising 50 mol % or more of a moiety of repeating constitutional units represented by formula (P) and formula (Q) below (P)

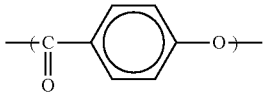

(Q)

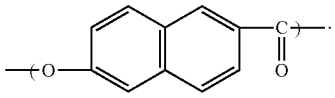

(Q)

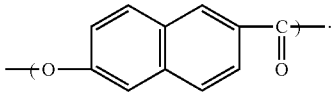

14. The flame resistant fabric according to claim 8, wherein a char length measured by a flame resistance test based on ASTM D6413-08 is 6 inches or less.

15. The flame resistant fabric according to claim 8, wherein a char length measured by a flame resistance test based on ASTM D6413-08 is 4 inches or less.

16. The flame resistant fabric according to claim 8, wherein the flame resistant fabric further comprises a para-aramid fiber in an amount of no more than 4 wt % relative to the total weight of the flame resistant fabric.

17. A flame resistant fabric comprising the flame resistant spun yarn according to claim 1.

18. Clothes comprising the flame resistant fabric according to claim 8.

19. Flame resistant work clothes comprising the flame resistant fabric according to claim 8.

20. The flame resistant spun yarn according to claim 2, wherein the naturally derived fiber is a natural fiber.

21. The flame resistant spun yarn according to claim 20, wherein the natural fiber is cotton.

22. The flame resistant fabric according to claim 9, wherein the naturally derived fiber is a natural fiber.

23. The flame resistant fabric according to claim 22, wherein the natural fiber is cotton.

* * * * *